US008827625B2

(12) United States Patent
Biggerstaff

(10) Patent No.: US 8,827,625 B2
(45) Date of Patent: Sep. 9, 2014

(54) LOAD ARM ARRANGEMENT FOR A SKID-STEER LOADER

(75) Inventor: Joseph M. Biggerstaff, Wichita, KS (US)

(73) Assignee: CNH Industrial America LLC, New Holland, PA (US)

( * ) Notice: Subject to any disclaimer, the term of this patent is extended or adjusted under 35 U.S.C. 154(b) by 779 days.

(21) Appl. No.: 12/862,841

(22) Filed: Aug. 25, 2010

(65) Prior Publication Data

US 2012/0051878 A1 Mar. 1, 2012

(51) Int. Cl.

| | |
|---|---|
| ***E02F 3/39*** | (2006.01) |
| ***E02F 3/42*** | (2006.01) |
| ***E02F 3/34*** | (2006.01) |

(52) U.S. Cl.

CPC ..... *E02F 3/3414* (2013.01); *E02F 3/422* (2013.01); *E02F 3/3411* (2013.01); *E02F 3/3402* (2013.01)

USPC ..... 414/718; 414/686; 414/697; 414/710; 414/728

(58) Field of Classification Search

USPC ..... 414/686, 697, 710, 718, 728

See application file for complete search history.

(56) References Cited

U.S. PATENT DOCUMENTS

| | | | | |
|---|---|---|---|---|
| RE23,466 | E * | 3/1952 | McElhinney | 414/718 |
| 3,001,654 | A | 9/1961 | Albert | |
| 3,648,871 | A * | 3/1972 | Layton | 414/715 |
| 3,913,768 | A * | 10/1975 | Grooss et al. | 414/711 |
| 4,162,873 | A | 7/1979 | Smith, Jr. | |
| 4,280,783 | A * | 7/1981 | Hayward | 414/686 |
| 5,807,061 | A | 9/1998 | Donoghue et al. | |
| 6,325,589 | B1 | 12/2001 | Jang et al. | |
| 6,726,437 | B2 | 4/2004 | Albright et al. | |
| 7,128,518 | B2 | 10/2006 | Yamashita | |
| 7,507,064 | B2 | 3/2009 | Shibuya | |
| 7,578,651 | B2 | 8/2009 | Layko et al. | |

FOREIGN PATENT DOCUMENTS

| | | | |
|---|---|---|---|
| EP | 1081292 | A1 | 7/2001 |
| EP | 1154081 | A2 | 11/2001 |
| JP | 63265022 | A | 11/1988 |
| JP | 2070834 | A | 3/1990 |
| JP | 6033476 | A | 2/1994 |

* cited by examiner

*Primary Examiner* — Scott Lowe
(74) *Attorney, Agent, or Firm* — Sue C. Watson

(57) ABSTRACT

A work vehicle includes a first loader arm portion pivotably connected at one end to a frame of the vehicle and configured to slidably receive a second loader arm portion along an opposed end of the first loader arm portion. A mechanical linkage interconnects the loader arm portions and the frame. A fluid cylinder operatively connected between each of the frame and the loader arm portions is configured to raise and lower the loader arm portions between a retracted (lowered) position and an extended (raised) position. As the fluid cylinder is actuated to urge the loader arm portions toward the extended (raised) position, the mechanical linkage results in slidable movement of the second loader arm portion with respect to the first loader arm portion so that a collective length of the loader arm portions in the extended (raised) position is increased.

13 Claims, 5 Drawing Sheets

LOAD ARM ARRANGEMENT FOR A SKID-STEER LOADER

FIELD OF THE INVENTION

The present invention relates generally to the field of work vehicles. It relates more particularly to work vehicles having pivoting loader arms for manipulating attachments.

BACKGROUND OF THE INVENTION

Work vehicles, such as skid steer loaders, include a pair of loader arms connected to an attachment, such as a bucket. In a conventional loader arm construction, each loader arm has a fixed length and rotates about a common axis that is secured to the frame of the vehicle, so that an attachment secured to the opposite ends of the lower arms traces a radial arc over its range of movement. With such a loader arm construction, as the loader arms are rotated toward an upwardly extending position, the attachment will likewise rotate toward the operator of the vehicle, increasing the difficulty associated with performing work tasks, and possibly resulting in a dangerous situation for the operator.

Accordingly, it would be advantageous to increase the length of the loader arms as the loader arms approach an upwardly extended position.

SUMMARY OF THE INVENTION

The present invention relates to a first loader arm portion pivotably connected to a frame, the first loading arm portion configured to slidably receive a second loader arm portion opposite the pivotable connection to the frame. A lever is pivotably connected to the first loader arm portion, the lever having a first opening and a second opening formed therein. A first arm is pivotably connected between each of the first opening of the lever and the frame. A second arm is pivotably connected between each of the second opening of the lever and the second loader arm portion. A fluid cylinder is operatively connected between the frame and the loader arm portions. The fluid cylinder is configured to raise and lower the loader arm portions between a retracted (lowered) position and an extended (raised) position. As the fluid cylinder is actuated to urge the loader arm portions toward the extended (raised) position, the lever, the first arm and second arm define a linkage between the frame and the loader arm portions. The linkage results in slidable movement of the second loader arm portion with respect to the first loader arm portion so that a collective length of the loader arm portions in the extended (raised) position is increased.

The present invention further relates to a work vehicle includes a first loader arm portion pivotably connected at one end to a frame of the vehicle and configured to slidably receive a second loader arm portion along the opposed end of the first loader arm portion. A mechanical linkage interconnects the loader arm portions and the frame. A fluid cylinder operatively connected between each of the frame and the loader arm portions is configured to raise and lower the loader arm portions between a retracted (lowered) position and an extended (raised) position. As the fluid cylinder is actuated to urge the loader arm portions toward the extended (raised) position, the mechanical linkage results in slidable movement of the second loader arm portion with respect to the first loader arm portion so that a collective length of the loader arm portions in the extended (raised) position is increased.

An advantage of the present invention is enhanced operating conditions for an operator of a work vehicle when the loader arms are in an upwardly extended position.

A further advantage of the present invention is improved visibility when the loader arms are near a downwardly retracted position.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
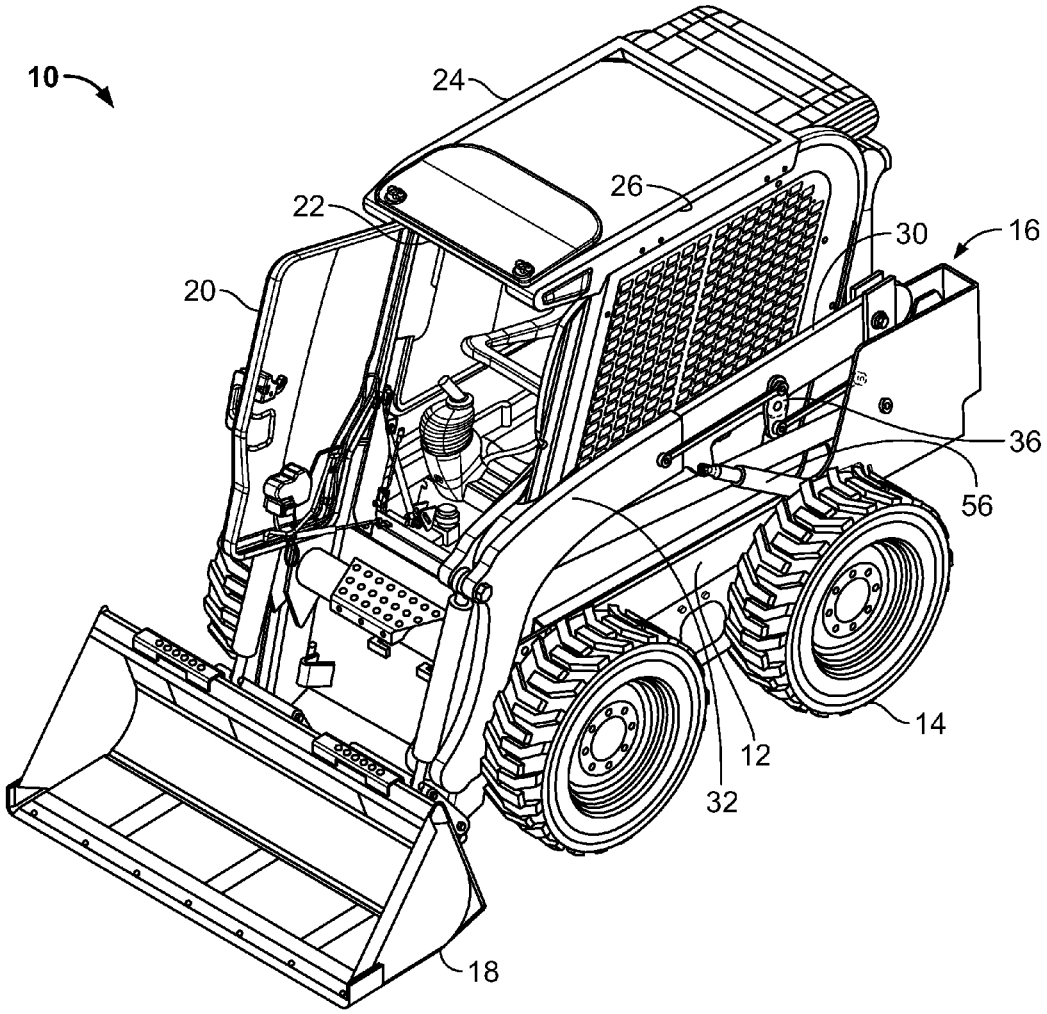
FIG. 1 is a top perspective view of an embodiment of a work vehicle of the present invention.

FIG. 1 shows a work vehicle 10 provided with a frame 12 that rotatably carries a plurality of wheels 14. A lifting structure 16 includes an arrangement of structural members and actuators controllable by an operator (not shown) to manipulate an implement 18 to perform work. Frame 12 structurally supports a cab structure 20 to surround and protect the operator, which frame 12 includes a front end 22 facing implement 18, with front end 22 positioned between opposed sides 24, 26 of the frame.

For FIGS. 2-5, each showing side 26 of frame 12 in side view, it is to be understood that the components identified with lifting structure 16 are also included with side 24. That is, for each component shown in FIGS. 2-5, an additional component associated with side 24 of frame 12 is not shown.

Figure 4:
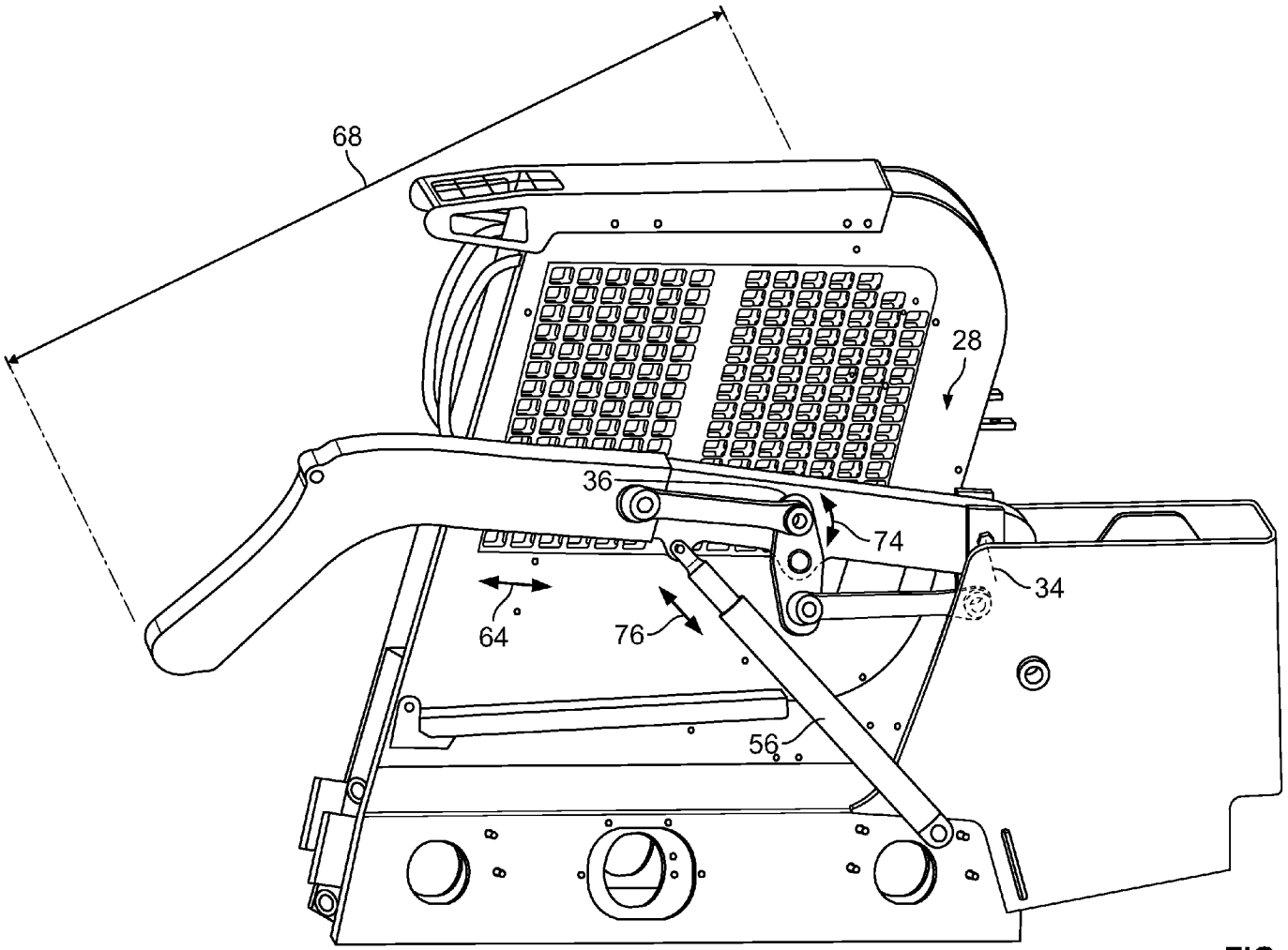
FIG. 4 is a side view of the work vehicle with the loader arms in an intermediate position of the present invention.

Lifting structure 16 includes a loader arm 28 comprising a first loader arm portion 30 that is pivotably connected to frame 12 about an axis 34. Opposite the pivotable connection about axis 34, first loader arm portion 30 is configured to slidably receive a second loader arm portion 32. In one embodiment, each of the first loader arm portions 30, 32 are tubes, such as round or rectangular shaped tubes. Although in one embodiment, an end of first loader arm portion 30 may be inserted inside of a corresponding end of second loader arm portion 32, in another embodiment, an end of second loader arm portion 32 facing first loader arm portion 30 may be inserted inside of the corresponding end of first loader arm portion 30. The slidable connection between the loader arm portions 30, 32 results in an axial movement 64 of second loader arm portion 32 with respect to first loader arm portion 30. The direction of axial movement 64 depends upon whether loader arm 28 is being raised toward an extended (raised) position and having a collective length 70 (FIG. 5), or is being lowered toward a retracted (lowered) position (FIG. 2) and having a collective length 66. That is, if loader arm 28 is being raised toward its extended position, second loader arm portion 32 will be urged into axial movement 64 in a direction away from first loader arm portion 30. Conversely, if loader arm 28 is being lowered toward its retracted position, second loader arm portion 32 will be urged into axial movement 64 in a direction toward first loader arm portion 30. As shown in FIG. 4, loader arm 28 is in an intermediate position between the extended position and a retracted position and having a collective length 68. As a result of axial movement 64 of second loader arm portion 32 with respect to first loader arm portion 30, collective length 70 of the loader arm in its extended (raise) position is greater than collective length 68 of the loader arm in its intermediate position. Collective length 68 of the loader arm in an intermediate position is greater than collective length 66 of the loader arm in its retracted (lowered) position. Stated another way, by virtue of a linkage 62 interconnecting loader arm portions 30, 32 and frame 12, to be explained in further detail below, in response to loader arm 28 being raised toward the extended position, the collective length of the loader arm is increased. Conversely, in response to loader arm 28 being lowered toward the retracted position, the collective length of the loader arm is decreased.

Linkage 62, which is a mechanical linkage, interconnects first loader arm portion 30, second loader arm portion 32 and vehicle frame 12. Linkage 62 includes a lever 36 that is pivotably connected to first loader arm portion 30 about an axis 42. In addition to an aperture 41, which permits the pivotable connection about axis 42, lever 36 further includes a first opening 38 and a second opening 40. First opening 38 is configured to form a pivotable connection with one end of a first arm 44 about an axis 46, with the opposed end of first arm 44 forming a pivotable connection with frame 12 about an axis 48. Second opening 40 is configured to form a pivotable connection with one end of a second arm 50 about an axis 52, with the opposed end of second arm 50 forming a pivotable connection with second loader arm portion 32 about an axis 54.

Figure 2:
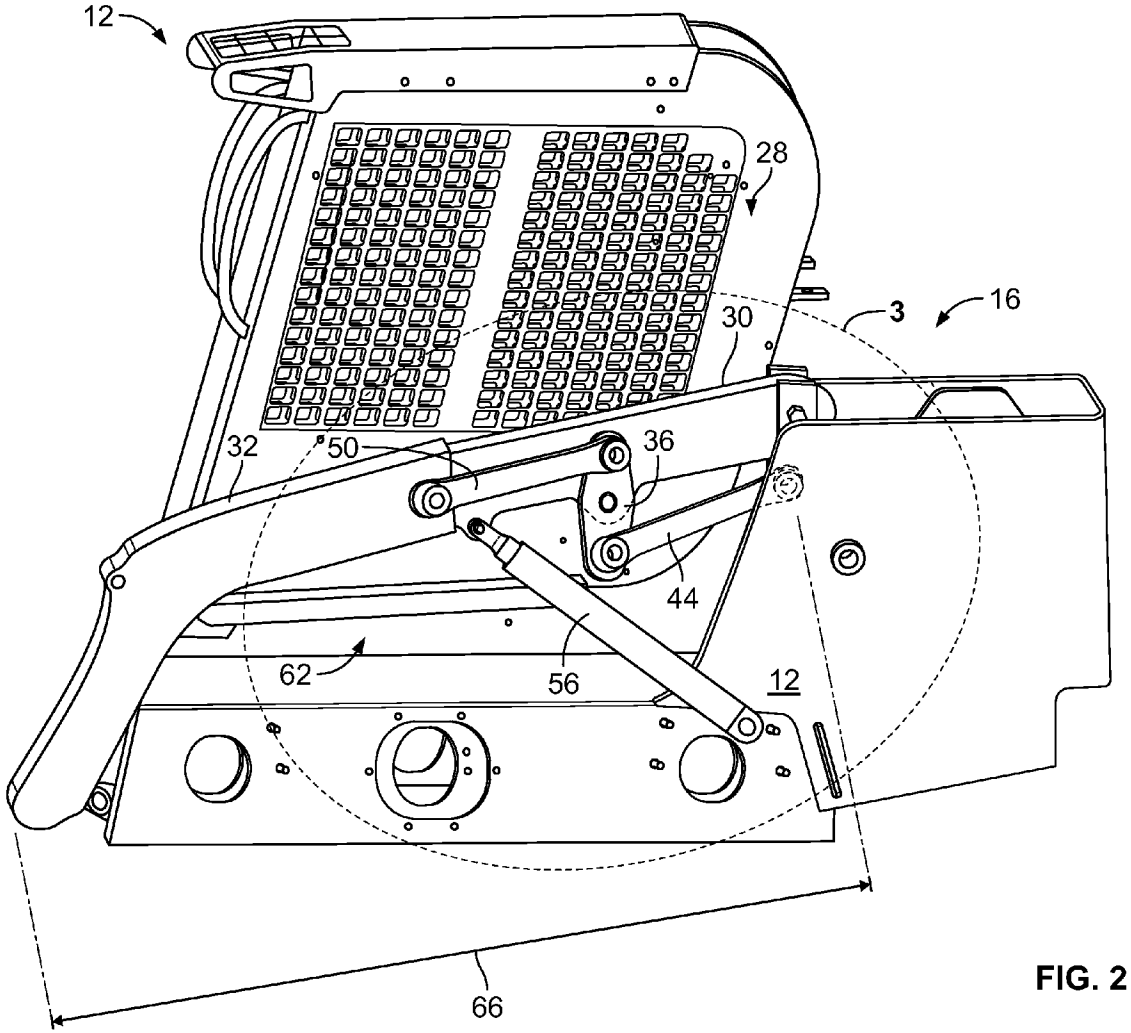
FIG. 2 is a side view of the work vehicle with the loader arms in a retracted (lowered) position of the present invention.
Figure 5:
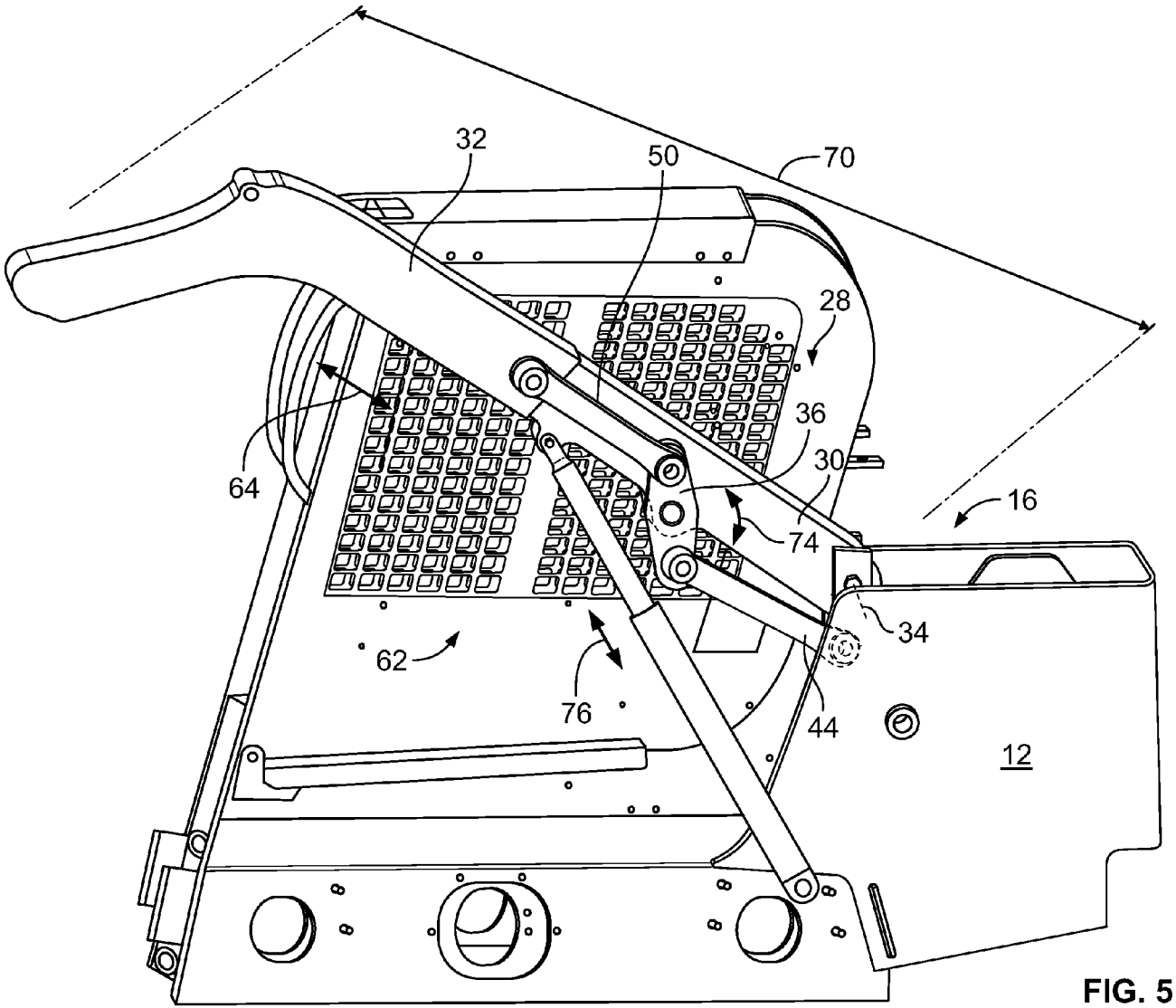
FIG. 5 is a side view of the work vehicle with the loader arms in an extended (raised) position of the present invention.

A fluid cylinder 56 is operably connected between frame 12 and loader arm portions 30, 32 and controls the angular position of the loader arm between the retracted and extended positions. Fluid cylinder 56 is pivotably connected to frame 12 about an axis 60, and as shown, is pivotably connected to first loader arm portion 30 about axis 58. In an alternate embodiment, instead of being pivotably connected to first loader arm portion 30, fluid cylinder 56 may be pivotably connected to second loader arm portion 32. Fluid cylinder 56 extends and retracts along directional arrow head 76. In response to fluid cylinder 56 being in its retracted position, loader arm 28 is also in its retracted position (FIG. 2). However, in response to the rod end of fluid cylinder 56 extending along directional arrow head 76, as shown in FIGS. 4-5, loader arm portions 30, 32 are urged to rotate about axis 34. Simultaneously, by virtue of the pivotable connection with first arm 44, lever 36 is urged into rotational movement 74 about axis 42 in a counterclockwise direction. In response to the counterclockwise rotational movement 74 of lever 36, second arm 50, which is pivotably connected to lever 36 about axis 52 and also pivotably connected to second loader arm portion 32, similarly urges second loader arm portion 32 into axial movement 64 in a direction away from first loader arm portion 30, resulting in an increase in the collective length of loader arm 28, such as collective length 68 when the loader arm has been partially raised (intermediate position) toward the extended position.

Figure 3:
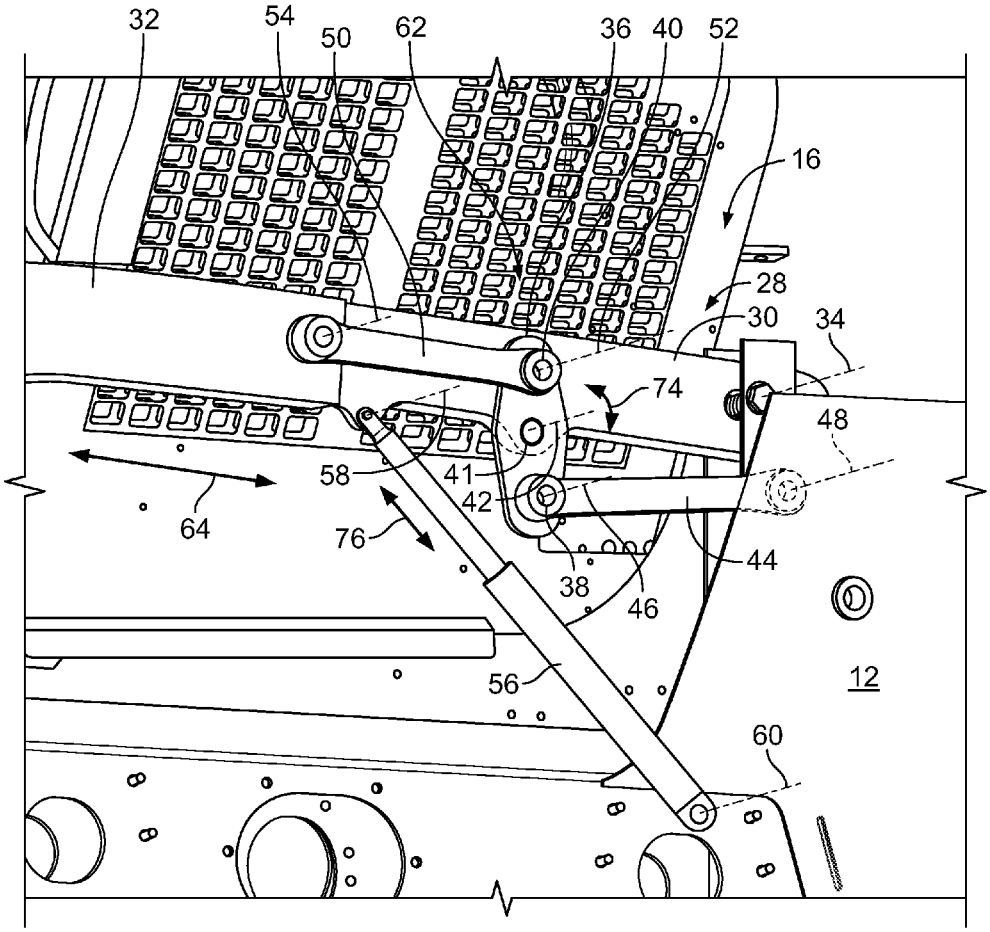
FIG. 3 is an enlarged view of a mechanical linkage of region 3 taken from FIG. 2 of the present invention.

In response to the rod end of fluid cylinder 56 further extending along directional arrow head 76, as shown in FIGS. 3 and 5, loader arm portions 30, 32 are urged to further rotate about axis 34. Simultaneously, by virtue of the pivotable connection with first arm 44, lever 36 is urged into further rotational movement 74 about axis 42 in a counterclockwise direction. In response to the additional counterclockwise rotational movement 74, second arm 50, which is pivotably connected to lever 36 about axis 52 and also pivotably connected to second loader arm portion 32, similarly urges second loader arm portion 32 into further axial movement 64 in a direction away from first loader arm position 30. Upon substantially full extension of fluid cylinder 56, loader arm 28 achieves its extended position, resulting in an increase in the collective length of loader arm 28 to a collective length 70.

By virtue of mechanical linkage 62, the linkage results in a gradual increase in the collective length of loader arm 28 as the loader arm is rotated about axis 34 from its retracted (lowered) position toward its extended (raised) position without the use of additional fluid cylinders. In addition, linkage 62 permits a lowering of the pivotable connection of the loader arm with respect to the frame 16 (axis 34), likewise permitting a lowering of loader arm 28, enhancing operator visibility when the loader arms operate near the retracted position. In one embodiment, when the loader arms are positioned near the retracted position, the loader arm may be maintained at or below the operator's line of sight through openings formed inside 24, 26 (FIG. 1) so as not to interfere with the operator's line of sight.

It is to be understood that while the construction of the lever in an exemplary embodiment may be symmetric about aperture 41 so that the distance between aperture 41 and the first and the second openings 38, 40 are the same, as well as the lengths of first and second arms 44, 50 appearing to be of the same length, the relative distances may significantly vary in response to application requirements.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A skid-steer loader comprising:

a first loader arm portion pivotably connected to a frame, the first loading arm portion configured to slidably receive a second loader arm portion opposite the pivotable connection to the frame;

a lever pivotably connected to the first loader arm portion, the lever having a first opening and a second opening formed therein;

a first arm pivotably connected between each of the first opening of the lever and the frame;

a second arm pivotably connected between each of the second opening of the lever and the second loader arm portion, wherein the lever, the first arm, and the second arm define a linkage between the frame and the loader arm portions; and a fluid cylinder connected between the frame and the first loader arm portion or between the frame and the second loader arm portion, the fluid cylinder configured to raise and lower the loader arm portions between a retracted lowered position and an extended raised position;

wherein as the fluid cylinder is actuated to urge the loader arm portions toward the extended raised position, the linkage causes slidable movement of the second loader arm portion with respect to the first loader arm portion so that a collective length of the loader arm portions in the extended raised position is increased, and wherein the first loader arm portion is pivotably connected to the frame in a fixed position relative to the pivotable connection of the first arm to the frame.

2. The skid-steer loader of claim 1, wherein the lever includes a first aperture to pivotably connect the lever to the first loader arm portion, the first aperture positioned between the first opening and the second opening, wherein a distance between the first aperture and the first opening is different than the distance between the first aperture and the second opening.

3. The skid-steer loader of claim 1, wherein when the loader arm portions are located near the retracted lowered position, the loader arm portions do not interfere with an operator's line of sight.

4. The skid-steer loader of claim 1, wherein the fluid cylinder is pivotably connected to the first loader arm portion.

5. The skid-steer loader of claim 1, wherein the fluid cylinder is pivotably connected to the second loader arm portion.

6. The skid-steer loader of claim 1, wherein the first arm has a different length than the second arm.

7. A work vehicle comprising:

a first loader arm portion pivotably connected at one end to a frame of the vehicle, the first loading arm portion configured to slidably receive a second loader arm portion along an opposed end of the first loader arm portion;

a mechanical linkage interconnecting the loader arm portions and the frame; and a fluid cylinder connected between the frame and the first loader arm portion or between the frame and the second loader arm portion, and configured to raise and lower the loader arm portions between a refracted lowered position and an extended raised position;

wherein as the fluid cylinder is actuated to urge the loader arm portions toward the extended raised position, the mechanical linkage between the frame and the loader arm portions causes slidable movement of the second loader arm portion with respect to the first loader arm portion so that a collective length of the loader arm portions in the extended raised position is increased, and wherein the first loader arm portion is pivotably connected to the frame in a fixed position relative to a connection between the mechanical linkage and the frame.

8. The work vehicle of claim 7, wherein the mechanical linkage comprises:

a lever pivotably connected to the first loader arm portion, the lever having a first opening and a second opening formed therein;

a first arm pivotably connected between each of the first opening of the lever and the frame; and a second arm pivotably connected between each of the second opening of the lever and the second loader arm portion, wherein the first loader arm portion is pivotably connected to the frame in the fixed position relative to the pivotable connection to the frame of the first arm.

9. The work vehicle of claim 8, wherein the lever includes a first aperture to pivotably connect the lever to the first loader arm portion, the first aperture positioned between the first opening and the second opening, wherein a distance between the first aperture and the first opening is different than the distance between the first aperture and the second opening.

10. The work vehicle of claim 7, wherein when the loader arm portions are located near the retracted lowered position, the loader arm portions do not interfere with an operator's line of sight.

11. The work vehicle of claim 7, wherein the fluid cylinder is pivotably connected to the first loader arm portion.

12. The work vehicle of claim 7, wherein the fluid cylinder is pivotably connected to the second loader arm portion.

13. The work vehicle of claim 7, wherein the first arm has a different length than the second arm.

* * * * *